US006867397B2

(12) United States Patent
Nishinomiya et al.

(10) Patent No.: US 6,867,397 B2
(45) Date of Patent: Mar. 15, 2005

(54) HEATING APPARATUS AND HEATING STABILIZATION DEVICE IN THEREOF

(75) Inventors: Takeshi Nishinomiya, Oura-gun (JP); Makoto Wakabayashi, Oura-gun (JP); Morihiro Sada, Kawasaki (JP); Hiroshi Takahashi, Oura-gun (JP); Hirofumi Terazaki, Oura-gun (JP)

(73) Assignee: Ajinomoto Co., Inc., Tokyo (JP)

( * ) Notice: Subject to any disclaimer, the term of this patent is extended or adjusted under 35 U.S.C. 154(b) by 116 days.

(21) Appl. No.: 10/189,012

(22) Filed: Jul. 5, 2002

(65) Prior Publication Data

US 2003/0015523 A1 Jan. 23, 2003

(30) Foreign Application Priority Data

Jul. 4, 2001 (JP) ..... 2001-203347
Apr. 3, 2002 (JP) ..... 2002-101647

(51) Int. Cl.[7] ..... H05B 6/16
(52) U.S. Cl. ..... 219/653; 399/328
(58) Field of Search ..... 219/653, 619, 219/645, 635, 602, 652; 399/328, 329, 330

(56) References Cited

U.S. PATENT DOCUMENTS 6,026,273 A * 2/2000 Kinouchi et al. ..... 399/328

FOREIGN PATENT DOCUMENTS

JP 05062762 A * 3/1993 ..... H05B/3/00

* cited by examiner

*Primary Examiner*—Quang T Van
(74) *Attorney, Agent, or Firm*—Oblon, Spivak, McClelland, Maier & Neustadt, P.C.

(57) ABSTRACT

A heating apparatus includes a steel belt conveyer having a steel belt with a top part that transports and heats, and induction heating coils having an elliptical or a rectangular shape disposed under or over the top part of the steel belt such that the longitudinal direction of each of the induction heating coils forms an angle of 45° to 135° inclusive with the moving direction of the steel belt. A heating stabilization device can be used in such an apparatus. The heating stabilization device has one or a plurality of rollers that are brought into contact with the top surface of the top part of the steel belt so that the top part of the steel belt is prevented from rising during a heating operation.

10 Claims, 6 Drawing Sheets

HEATING APPARATUS AND HEATING STABILIZATION DEVICE IN THEREOF

BACKGROUND OF THE INVENTION

CROSS-REFERENCE TO RELATED APPLICATIONS

The application claims priority to Japanese application nos. 203347/2001 and 101647/2002, the disclosures of which are incorporated by reference herein in their entirety.

FIELD OF THE INVENTION

The present invention relates to a heating apparatus that uses a steel belt as a heating body and enables uniform heating, the steel belt being heated by electromagnetic induction coils.

DESCRIPTION OF THE BACKGROUND

It is known to use steel belt conveyers for heating food continuously. Gas heating type steel belt ovens are used for baking confectioneries such as cookies and cream puffs. However, problems with these apparatuses include low energy efficiency, and concerns regarding safety due to use of fire.

Japanese Patent Laid-Open No. 215605/1997 describes a heat-processing apparatus using a steel belt that is heated by induction heating coils. This invention remedies, to some extent, the above-discussed problems that are caused by gas heating, and attains uniform heating by swinging induction heating coils. A mechanical slide driving means having an air cylinder and a cam or other generally known swinging means are used to swing the coils.

To attain uniform heating, it is necessary to calculate a swing pattern based on a heating profile of a coil in a stationary state. However, even if a swing pattern for attaining uniform heating is calculated, it is difficult to realize the pattern by reciprocating the swings with an air cylinder and a cam or the like. As a result, uniform heating cannot be attained without using an expensive system including a combination of thermography, a computer, a servo motor, etc.

When heated by a method that is not restricted to induction heating, a steel belt expands based on its material, the temperature, etc. Part of the expansion of the steel belt is captivated by the tension of springs that are connected to pulleys located at both ends to hold the steel belt. However, there remain portions of the steel belt where the expansion is not completely captivated, and as a result, a portion of the steel belt rises over its whole width, and a portion has only its central portion rise. A steel conveyer is supported from below by rollers or the like and therefore the steel belt moves upward instead of downward.

Where a steel belt is heated with gas, even if a portion of the steel belt is moved, a variation in the heat value received by that portion of the steel belt is small. However, where a steel belt is heated by induction heating, if a portion of the steel belt is moved, the heating efficiency is lowered to a larger extent, such that the portion is insufficiently heated. If the distance between the steel belt and an induction coil becomes greater than a predetermined distance, heating is substantially prevented. The portion of the steel belt that has expanded and risen is heated incompletely and therefore objects of heating that are mounted thereon are not heated in a desired manner. This problem generally does not occur when the conveyer has a length less than 5 m, and occurs more frequently as the conveyer becomes longer.

This problem occurs more frequently in the case of rapid heating or cooling. For example, where food is heated and cooked on a conveyer, the temperature of a portion of the steel belt where objects of heating are mounted rises less because of evaporation of water from the objects during heating. In contrast, the temperature of a portion of the steel belt where no objects of heating are mounted rises to a greater extent. Thus, a large temperature variation occurs near objects of heating.

As described above, in heating apparatuses in which a steel belt and induction heating coils are used in combination, particularly where the conveyer is longer than 5 m, heating is insufficient due to the rise of the steel belt that produces a non-uniform temperature profile for the steel belt.

SUMMARY OF THE INVENTION

The present invention advantageously provides a heating apparatus capable of processing food uniformly by heating, and provides a device for providing a stable heating operation in a heating apparatus using a steel belt and induction heating coils.

In a food heating apparatus in which the top part of the steel belt of a steel belt conveyer serves for transport and heating, and induction heating coils are disposed under or over the top part of the steel belt, heating can be made uniform in a width direction of the steel belt by giving the induction heating coils an elliptical or rectangular shape and disposing the induction heating coils such that the longitudinal direction of each of the induction heating coils forms an angle of 45° to 135° inclusive with the moving direction of the steel belt. Further, by making a length of the induction heating coils in the longitudinal direction greater than the width of the steel belt, magnetic fields produced by only the straight portions of the induction heating coils contribute to heating, thereby attaining uniform heating.

The heating stabilization device can include one or a plurality of rollers that are brought into contact with the top surface of the top part of the steel belt to prevent the top part of the steel belt from rising during a heating operation.

The steel belt conveyer can be provided by forming a steel band into a ring-shaped belt driven while both ends are pulled outward with pulleys. Although the thickness of a steel material to be used for forming the steel belt can be determined by evaluating desired belt strength and drivability, it is preferable to use a known steel band having a thickness of 0.8–1.5 mm. Further, the steel belt can be manufactured from any material in which eddy current can be generated by electromagnetic induction. The material of the steel belt can be determined by evaluating desired thermal conductivity, mechanical strength, workability, corrosion resistance, economy, etc.

The induction heating coil can include a coil having a circular, elliptical or rectangular shape, of wire, such as a copper wire having a flat, rectangular shape. The coil material, the number of turns, etc. can be those of known induction heating coils. Each induction heating coil can be disposed such that the straight portions opposed to each other (in the case of an elliptical coil) or the longer sides opposed to each other (in the case of a rectangular coil) form an angle of 45° to 135° inclusive, preferably 60° to 120° inclusive, and more preferably 85° to 95° inclusive, with the moving direction of the steel belt. Although it is preferable to dispose each induction heating coil such that its longitudinal direction is perpendicular to the moving direction of the steel belt, food can be heated uniformly as long as the angle between the longitudinal direction of each coil and the moving direction of the steel belt is greater than or equal to 45°, an optimal angle depending on the transport speed of the steel belt conveyer.

The length of the straight portions of each induction heating coil in the width direction of the steel belt can be greater than the width of part of the steel belt used for uniform heating of objects. Where the temperature profile along a line traversing the steel belt in the width direction has a large variation, a high-temperature portion and a low-temperature portion of the belt may have a large difference in the amount of expansion and thereby distort the top part of the steel belt. The distortion makes the distance between the top part of the steel belt and an induction heating coil deviate from the predetermined distance. The induction heating by the coil that is not separated from top part of the steel belt by the predetermined distance increases the variation of the temperature profile and hence increases the distortion.

To prevent such distortion, the length of the straight portions of each induction heating coil in the width direction of the steel belt can be greater than the width of the steel belt, so that magnetic fields generated by only the straight portions of each induction heating coil contribute to induction heating. Magnetic fields generated by a radio-frequency current flowing through the straight portions of each induction heating coil can cause approximately uniform eddy currents in a portion of the steel belt along the line that traverses the belt in the width direction. The heated portion becomes almost straight and thereby uniformly heats the entire width of the steel belt. To prevent undesirable heating of nearby metal portions, the portions of each induction heating coil that are located outside the steel belt can be bent away from the steel belt.

Because the belt surface temperature is made uniform in the width direction, the frying colors of pieces of food in which importance is given to the color and browning of the fried surface, such as a hamburger, a Chinese fried meat dumpling, a baked rice ball, two small pancakes with bean jam in between, okonomiyaki (a meat and vegetable pancake), or an omelet, can be made uniform.

Thus, it is not necessary to swing the induction heating coils to make heating of the belt uniform, thereby eliminating the known process of calculating a swing pattern based on a measurement of a surface temperature distribution and swinging the induction heating coils according to the calculated swing pattern. The food heating apparatus according to the invention is simpler and superior in cost and durability.

A known method of controlling the induction heating coils can be used. For example, the coil output may be adjusted by detecting surface temperatures of the steel belt or room temperature and performing feedback control.

A device capable of steaming food may be disposed so as to coextend with all or part of the steel belt in its moving direction. Thus, steaming and frying (browning) can be performed in a single step, and thus the food heating apparatus can be used for cooking a wider variety of foods.

A device (spray nozzle) capable of spraying a liquid, such as cool or hot water, may be disposed above the steel belt at one or a plurality of positions in the moving direction of the steel belt. Water can be supplied to food to compensate for water that is lost by heating, thereby preventing the food from being fried excessively and degraded in quality.

Further, the device capable of steaming food and the device capable of spraying a liquid can be used together. This is suitable for cooking of Chinese fried meat dumplings. Specifically, such an apparatus allows cooking of the noodle wrappings and the ingredients by steaming, prevents excess frying and solidification of the noodle wrappings (particularly the ear or gathered portions) by spraying of cold water or hot water, and realizes uniform fried surfaces by induction heating from the steel belt.

In heating apparatuses, particularly those in which the conveyer has a length greater than 5 m, the heating can become insufficient due to a rise of the top part of the steel belt, thereby producing a non-uniform temperature profile of the top part of the steel belt. The rise of the top part of the steel belt can be prevented by disposing one or a plurality of rollers in contact with the top surface of the top part of the steel belt, thereby preventing the top part of the steel belt from moving upward from its initial elevation.

Any material can be used for the rollers as long as it remains rigid at a maximum temperature that is reached at a position of actual use and does not have an adverse effect on the heating apparatus or objects of heating. For example, a tetrafluoroethylene resin or the like can be used.

The rollers can be at least thick enough to withstand a stress that is exerted thereon when the top part of the steel belt expands. Where the rollers are made of a tetrafluoroethylene resin, it is preferable that the rollers have a thickness of 10 mm or more. However, the rollers should not be so thick as to contact or crush objects of heating.

The rollers can be supported by a variety of methods. A preferred method is to connect and fix a shaft to portions of the body of the heating apparatus that are located outside the top part of the steel belt. As for a vertical elevation of the rollers, it is preferable that the rollers be disposed such that the bottoms of the respective rollers are in contact with the top surface of the top part of the steel belt when a heating operation is not performed. However, the rollers may be disposed above or below the above-discussed position depending on how the top part of the steel belt expands when a heating operation is performed. Where the rollers are disposed below the above-discussed position, the exertion of excessive stress on the top part of the steel belt can be avoided.

The rollers may be disposed at any positions in the width direction of the top part of the steel belt. The rollers may be disposed at the ends of the top part of the steel belt or positions inside thereof. The rollers may be disposed at any positions in the moving direction of the top part of the steel belt. The positions of the rollers may be determined by conducting tests under a variety of conditions, as the optimum positions depend on the shape and capability of the heating apparatus, the type of object to be heated, the heating conditions, etc. Sufficient care can be taken so that the rollers will not contact or crush objects of heating.

Where the top part of the steel belt zigzags to a relatively large extent during a heating operation, the rollers can separate from end portions of the top part of the steel belt or crush objects of heating. In such a case, it is preferable to use a structure that causes the rollers to follow zigzagging of the top part of the steel belt, such that the relative positional relationships between the rollers and the top part of the steel belt remain constant.

The invention can be applied not only to apparatuses having a steel belt conveyer that serves for transport and heating, but also to apparatuses having a plate conveyer including a mechanism for continuously driving frying plates. Examples of such a driving mechanism include a mechanism in which frying plates are arranged on and joined to drive chains at both ends or both ends and intermediate positions of each frying plate and the frying plates are driven together with the drive chains, a mechanism in which frying plates arranged on drive chains are transported such that transport nails provided on the drive chains are hooked on the frying plates, and a mechanism in which frying plates are mounted on a roller conveyer and transported by rotation of drive rollers. In the case of the plate conveyer, because it is not necessary to bend the frying plates during the driving, a thick metal plate can be used to prevent the conveyer from warping due to its own weight and thermal distortion. It is preferable that the thickness be 2–10 mm.

The above description is directed to the food heating apparatus as a specific example. It is to be understood, however, that the invention can also be applied to other various heat-processing apparatuses, such as those used for heat-processing rubber or synthetic resin, and for aging a metal material.

DESCRIPTION OF THE PREFERRED EMBODIMENTS

Figure 1:
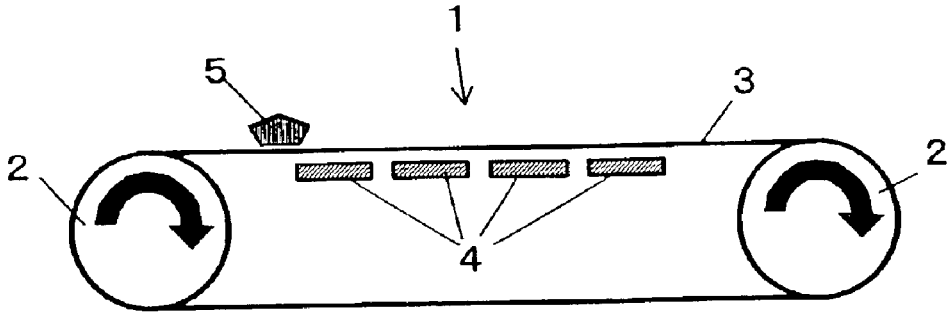
FIG. 1 is a side view of a food heating apparatus according to the invention.

A food heating apparatus according to the present invention will be described in detail with reference to the accompanying drawings. FIG. 1 is a side view of the food heating apparatus 1. In the food heating apparatus 1, a steel belt 3 is wound on two driving pulleys 2. The top surface of the top part of the steel belt 3 serves as a surface for transporting objects 5 to be heated. Induction heating coils 4 are disposed a predetermined distance under the top part of the steel belt 3.

Figure 2:
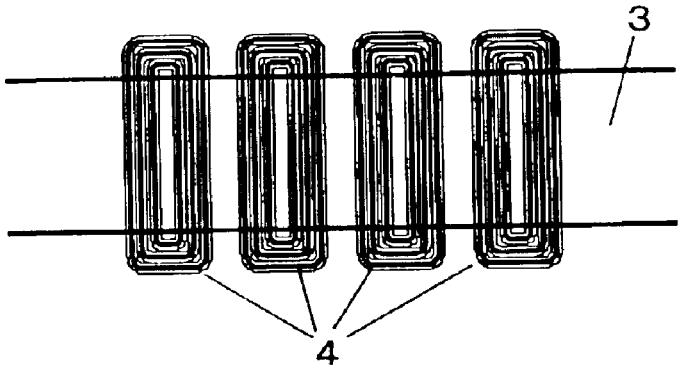
FIG. 2 is a top view of the food heating apparatus of FIG. 1 including coils.

FIG. 2 is a top view of the apparatus 1 showing a location of the induction heating coils 4. As shown in FIG. 1, the induction heating coils 4 are disposed under the top part of the steel belt 3. Each of the induction heating coils 4 may have a rectangular shape in which the longer sides of the rectangle have a length greater than the width of the steel belt 3. The straight portions of the coils 4 can contribute to induction heating of the steel belt 3, enabling uniform heating in the width direction of the steel belt 3.

In the food heating apparatus 1, for example, objects 5 to be heated that are supplied continuously onto the steel belt 3 from the input pulley side are subjected to heat processing (such as frying) while passing over the induction heating coils 4, and are then output continuously from the output pulley side. A means for supplying objects 5 to be heated and a means for unloading those at the respective ends of the food heating apparatus 1 can be provided to perform a continuous automatic operation.

Figure 3:
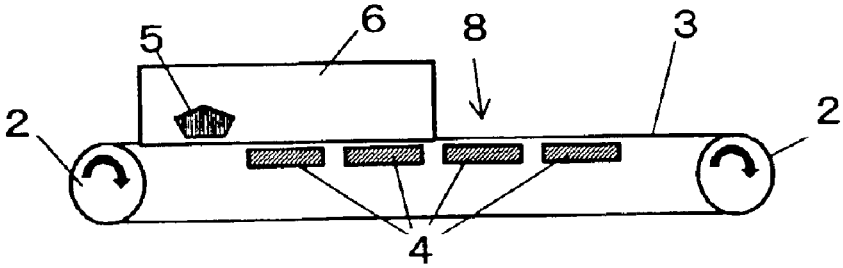
FIG. 3 is a side view of a food heating apparatus including a steaming means.

FIG. 3 shows a food heating apparatus 8 having a steaming device in which the food heating apparatus 1 and a tunnel-type steaming room 6 that acts as a steaming means are used. Objects 5 to be heated are steamed while passing through the steaming room 6, and are also fried by the top part of the steel belt 3 that is heated by the induction heating coils 4. In the belt moving direction, the steaming room 6 may coextend with all or part of a length of the food heating apparatus 8, and the length of the steaming room 6 may be determined in accordance with the cooking characteristics of the objects 5. The steaming and frying may be performed either simultaneously or separately, and related conditions may be determined also in accordance with the cooking characteristics of the objects 5.

Figure 4:
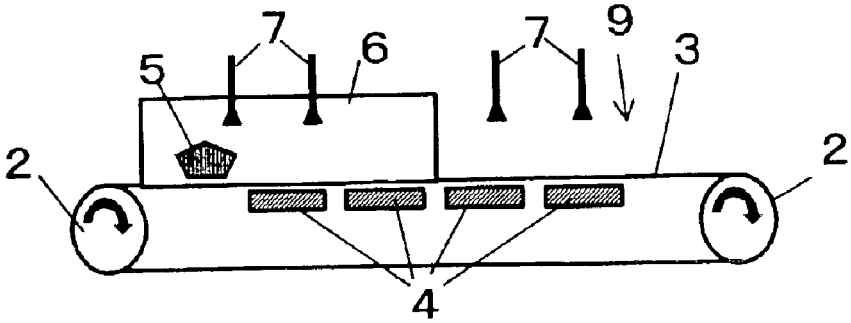
FIG. 4 is a side view of a food heating apparatus including a steaming means and a spraying means.

FIG. 4 shows a food heating apparatus 9 having a liquid spraying device and a steaming device. The food heating apparatus 9 includes spray nozzles 7 for spraying a liquid such as cool or hot water from above during passage of objects 5 to be heated through the food heating apparatus 9. Objects 5 to be heated are steamed while passing through the steaming room 6. Cool or hot water is sprayed on the objects by the spray nozzles 7, and the objects 5 are fried by means of the top part of the steam belt 3 that is heated by the induction heating coils 4. The apparatus can also include the spray nozzles 7 without the steaming room 6. Spraying may be performed inside the steaming room 6, outside the steaming room 6, and in both locations. The relationship between the positions of the induction heating coils 4 and the positions of the spray nozzles 7 may be determined arbitrarily. Each of the above factors may be determined in accordance with the cooking characteristics of the objects 5.

Figure 10:
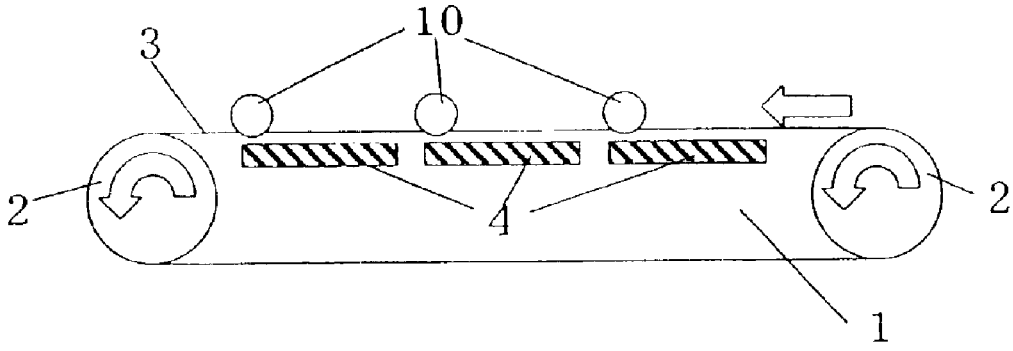
FIG. 10 is a side view of a heating apparatus provided with heating stabilization devices.

FIG. 10 is a side view of a heating apparatus 1 including heating stabilization devices. In the heating apparatus 1, a steel belt 3 is wound on two driving pulleys 2. The top surface of the top part of the steel belt 3 serves as an object heating surface and an object transport surface. Induction heating coils 4 are disposed a predetermined distance under the top part of the steel belt 3. Rollers 10 acting as heating stabilization devices are disposed in contact with the top surface of the top part of the steel belt 3.

Although the rollers 10 may be disposed at any positions in the moving direction and the width direction of the top part of the steel belt 3, preferably the rollers 10 are disposed to suppress distortion of the top part of the steel belt 3. For example, the rollers 10 can be disposed over the downstream ends of the induction heating coils 4. Where the coils 4 are arranged as shown in FIG. 1, the top part of the steel belt 3 is heated above the coils 4 but is not heated at all in the regions over the gaps between the coils 4. Therefore, distortion tends to occur in the top part of the steel belt 3 over the downstream end of each coil 4.

Figure 11:
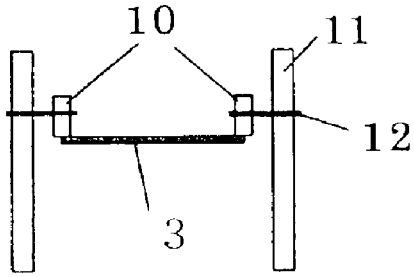
FIG. 11 is a front view of a heating apparatus in which heating stabilization devices are disposed at both ends of the top part of a steel belt.

FIG. 11 is a front view of a heating apparatus in which heating stabilization devices are disposed at both ends of the top part of the steel belt 3. Rollers 10 are disposed at both ends of the top part of the steel belt 3 in contact with its top surface, and are fixed to portions 11 of the body of the heating apparatus via roller support shafts 12. This arrangement of the rollers 10 can be used where the steel belt 3 is relatively narrow, for example, 800 mm or less in width, and the degree of zigzagging or vertical displacement is relatively low. Where the width of the steel belt 3 is greater than 800 mm, a central portion of the top part of the steel belt 3 can rise such that distortion cannot be removed by pushing or contacting both end portions of the steel belt 3. In this case, an end portion of the top part of the steel belt 3 may separate from the roller 10 when the degree of zigzagging is high.

Figure 12:
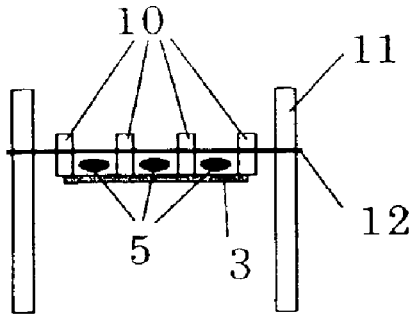
FIG. 12 is a front view a heating apparatus in which heating stabilization devices are disposed at both ends and inside positions of the top part of a steel belt.

FIG. 12 is a front view of a heating apparatus in which heating stabilization devices are disposed at both ends and inside positions of the top part of the steel belt 3. Rollers 10 are disposed at both ends and inside positions of the top part of the steel belt 3 in contact with its top surface, and are fixed to portions 11 of the body of the heating apparatus via roller support shafts 12. The rollers 10 are disposed at such positions as not to interfere with objects 5 to be heated. This arrangement of the rollers 10 can be used when the width of the steel belt 3 is greater than 800 mm, for example, the central portion of the top part of the steel belt 3 rises, and the degree of zigzagging is relatively low. The number of rollers 10 can be determined by considering the width of the steel belt 3, the shape of objects 5, the number of objects 5, the positions of objects 5 on the steel belt 3, the degree of distortion of the top part of the steel belt 3 that occurs when the rollers 10 are not used, and other factors. However, in this case, an end portion of the top part of the steel belt 3 may separate from the roller 10 or the rollers may interfere with objects of heating when the degree of zigzagging is high.

Figure 13:
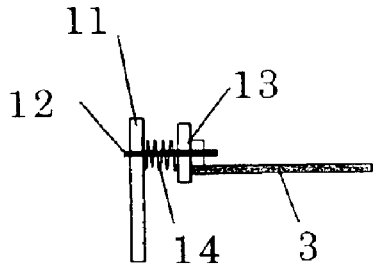
FIG. 13 is a front view showing a heating stabilization device having a mechanism for allowing it to follow zigzagging of the top part of a steel belt.

FIG. 13 is a front view showing a heating stabilization device having a mechanism for allowing it to follow zigzagging of the top part of the steel belt 3. Each two-step roller 13 is formed by bonding or connecting two rollers having different diameters concentric with each other. The roller may be formed by a cutting operation. The two-step roller 13 is fixed to a portion 11 of the body of the heating apparatus via a roller support shaft 12. A spring 14, which is inserted in the roller support shaft 12, exerts, on the two-step roller 13, a force that causes the two-step roller 13 to follow the top part of the steel belt 3. The two-step roller 13 is disposed such that its smaller-diameter roller is in contact with the top surface of the associated end portion of the top part of the steel belt 3 and the side surface of its larger-diameter roller is laterally in contact with the outside surface of the associated end portion. By this arrangement, each two-step roller 13 contacts the associated end portion of the top part of the steel belt 3 by virtue of the force of the spring 14 and hence follows the zigzagging of the steel belt 3. Thus, each two-step roller 13 does not separate from the top part of the steel belt 3. The pushing force of the spring 14 can be set such as not to cause zigzagging of the top part of the steel belt 3.

Figure 14:
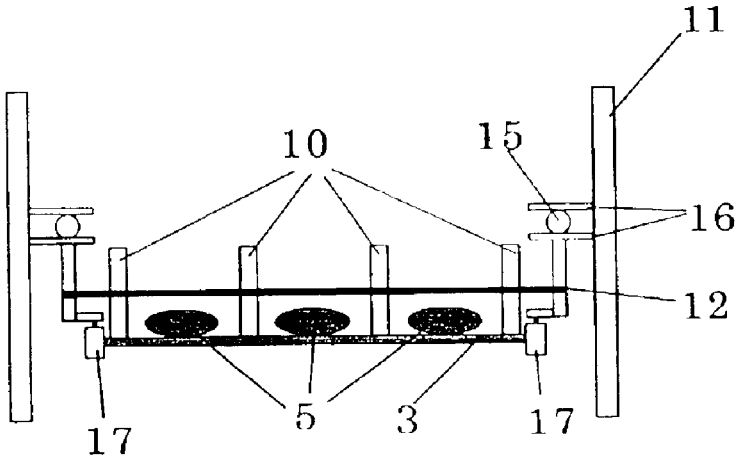
FIGS. 14 and 15 are a front view and a side view, respectively, showing a heating stabilization device having a mechanism for allowing it to follow zigzagging of the top part of the steel belt.
Figure 15:
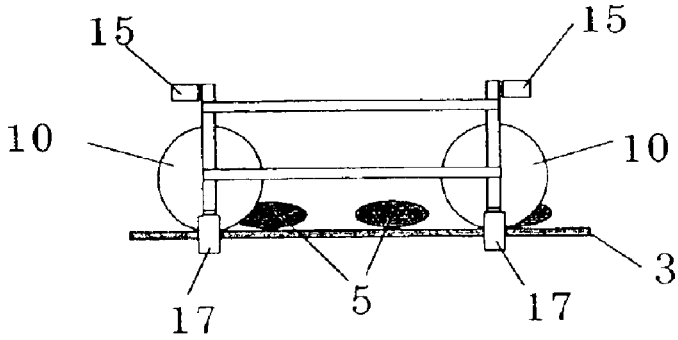

FIGS. 14 and 15 are a front view and a side view, respectively, showing a heating stabilization device having a mechanism for allowing it to follow zigzagging of the top part of the steel belt 3. The heating stabilization device has a unit-type structure in which four rollers 10 are arranged in two columns and connected to each other. Thus, the unit is formed such that the rollers 10 that are supported by roller support shafts 12, guide rollers 17 that are in contact with end portions of the top part of the steel belt 3 and have respective vertical rotation axes, and heating stabilization device support rollers 15, each of which is interposed between heating stabilization device support portions 16 that are connected to the associated portion 11 of the body of the heating stabilization apparatus, are connected to each other. Even when the top part of the steel belt 3 is zigzagged, the guide rollers 17 and hence the whole unit follows the top part such that the relative positional relationships between the top part of the steel belt 3 and the rollers 10 remain constant. Any number of rollers 10 can be arranged in the width direction and in the belt moving direction.

In the unit-type heating stabilization device of FIGS. 14 and 15, electrical means may be used for detecting zigzagging of the steel belt 3 and causing the heating stabilization device to follow it. For example, position sensors for detecting the ends of the top part of the steel belt 3 and a motor for driving the heating stabilization device unit in the width direction may be used. Each position sensor may be a photoelectric sensor, a proximity sensor, a displacement sensor, an image sensor, or the like.

A specific example will be described below.

EXAMPLE 1

A temperature distribution of the top surface of the top part of a rotating steel belt was observed with a "Thermography" instrument (manufactured by Nippon Avionics Co., Ltd.) for a case in which a set of two elliptical coils having a relatively large major-axis-to-minor axis ratio was disposed such that the longitudinal directions of the respective coils were perpendicular to the belt moving direction as disclosed in the present invention, a case (Comparative Example 1) in which a set of three elliptical coils having a relatively large major-axis-to-minor axis ratio was disposed in such a manner that the longitudinal directions of the respective coils were parallel with the belt moving direction, and a case (Comparative Example 2) in which coils were arranged in the same manner as in Comparative Example 1 and were swung by an air cylinder.

Figure 5:
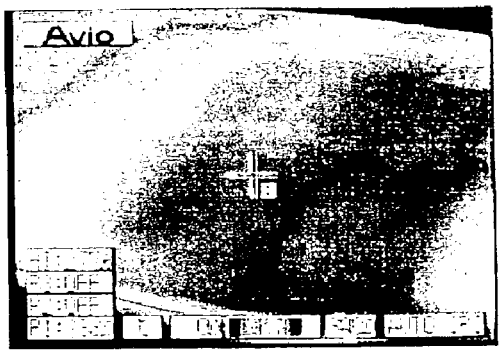
FIG. 5 is a photograph showing a temperature distribution where coils are arranged such that their longitudinal directions are perpendicular to the belt moving direction.
Figure 6:
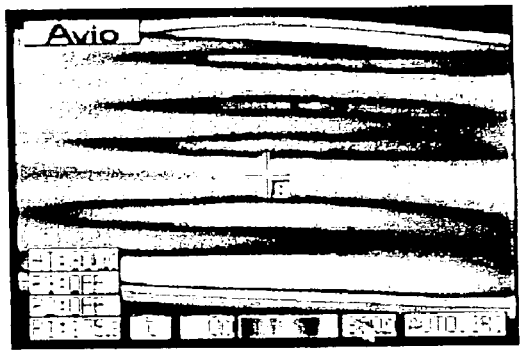
FIG. 6 is a photograph showing a temperature distribution where coils are arranged such that their longitudinal directions are parallel with the belt moving direction.
Figure 7:
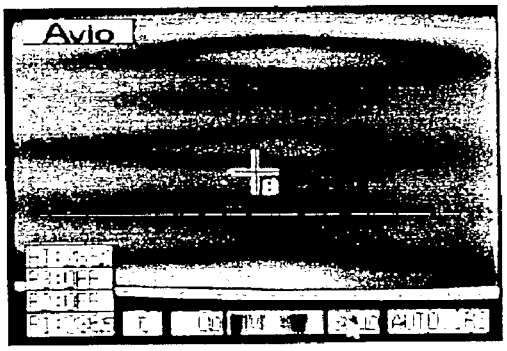
FIG. 7 is a photograph showing a temperature distribution wherein coils are arranged such that their longitudinal directions are parallel with the belt moving direction and the coils are swung by an air cylinder.

In Comparative Example 1 (see FIG. 6), temperature unevenness was evident in the width direction of the steel belt. Temperature unevenness in the width direction was also evident in Comparative Example 2 (see FIG. 7) in which the coils were swung. As shown in FIG. 5, in the arrangement according to the invention, no significant temperature unevenness was evident in the present width direction of the steel belt and lines where the displayed color changed were perpendicularly to the belt moving direction, meaning heating was performed uniformly in the width direction.

Figure 8:
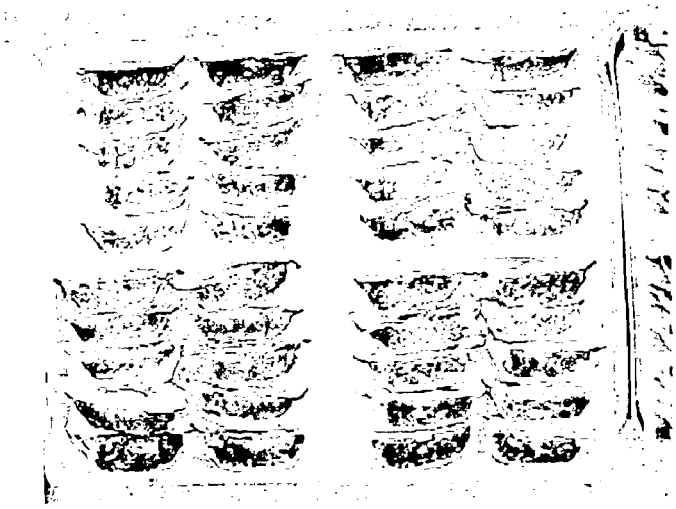
FIG. 8 is a photograph of Chinese fried meat dumplings produced by frying meat dumplings continuously by using the coils.
Figure 9:
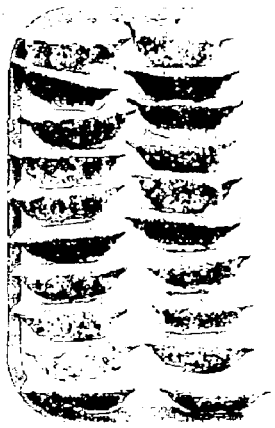
FIG. 9 is a photograph of Chinese fried meat dumplings produced by frying meat dumplings continuously by using the coils arranged according to the Comparative Examples.

FIGS. 8 and 9 are photographs of Chinese fried meat dumplings that were produced by continuously frying meat dumplings disposed such that 10 pieces were arranged in the width direction of a steel belt having an effective heating width of 350 mm. In the arrangement according to the invention (see FIG. 8), the frying colors of the resulting Chinese fried meat dumplings were uniform in the width direction. The dumplings had no unevenness due to the placement position in the width direction.

EXAMPLE 2

A carbon hardened steel belt of 1.2 mm in thickness, 1 m in width, and 60 m in length was formed into an endless belt, which was wound on two pulleys that are 800 mm in both diameter and width, to form a steel belt conveyer having a total length of about 30 m. Ten (10) induction heating coils, each capable of being housed in an 1 m square unit, were provided, and were arranged adjacent to an 11 m long, downstream portion of the top part of the steel belt under the bottom surface of the top part of the steel belt (distance: 10 mm). The coils were separated from each other by about 100 mm. Each coil unit was connected to an induction heating inverter of 30 kW. A temperature sensor was disposed under the bottom surface of a central portion, in the width direction, of the top part of the steel belt at a position 50 mm downstream from the coil unit. Each temperature sensor was disposed to be kept in contact with the bottom surface of the top part of the steel belt by a spring. A measurement value of each temperature sensors was supplied to a temperature controller. Setting of a predetermined temperature was accomplished by each combination of a temperature sensor and a temperature controller.

Figure 18:
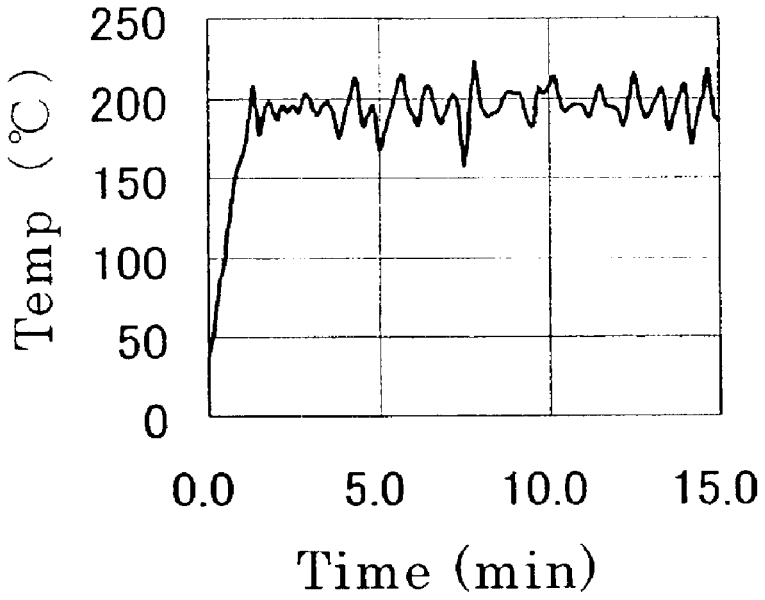
FIG. 18 is a graph showing a temperature variation of a position on the bottom surface of the top part of a steel belt in a heating apparatus without heating stabilization devices.

The above heating apparatus was started under conditions where the belt moving speed was 3 m/min and the setting temperatures of the respective coil units were 120° C., 120° C., 120° C., 160° C., 160° C., 160° C., 200° C., 200° C., 200° C., and 220° C. in order from the upstream end. After an interval of two minutes from the start of heating, it was found that the steel belt was distorted and rose by about 20 mm in the downstream half of the 11 m portion adjacent to which the coils were disposed. A portion of the top part of the steel belt rose, the induction heating coil corresponding to that portion was turned off to stop heating, the temperature of that portion of the top part of the steel belt subsequently decreased and the portion approached the coil and was heated again. FIG. 18 shows a temperature variation (over an interval of 15 minutes from the start) at a position 50 mm downstream from the seventh coil unit (as counted from the upstream-end coil unit), on the bottom surface of a central portion, in the width direction, of the top part of the steel belt. Here, irregular fluctuations occurred for the setting temperature of 200° C. Objects were heated using the above heating apparatus. Overbaked and underbaked objects occurred in an irregular manner; that is, the heating operation was unstable.

Figure 16:
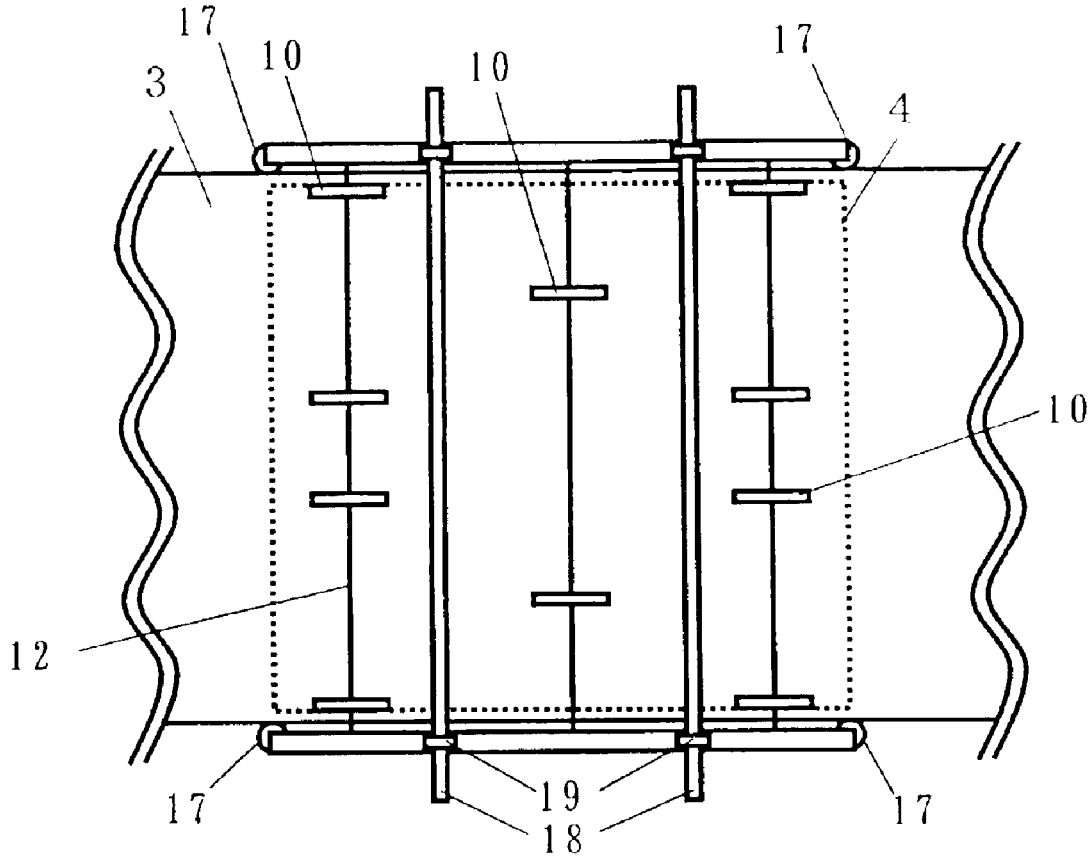
FIGS. 16 and 17 are a plan view and a side view, respectively, showing a heating stabilization device having a mechanism for allowing it to follow zigzagging of the top part of the steel belt.
Figure 17:
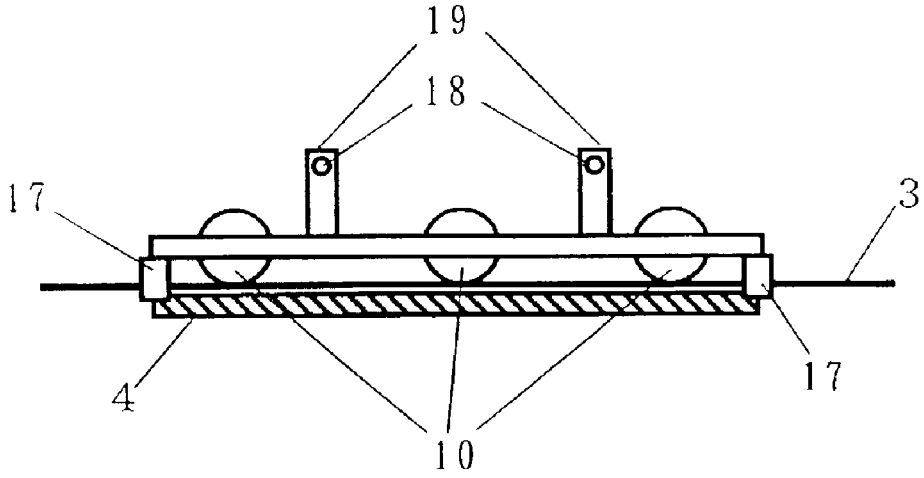

In view of the above-discussed problems, the unit-type heating stabilization devices shown in FIGS. 16 (plan view) and 17 (side view) were used. Each unit occupied approximately the same area as the one 1m square induction heating coil 4, and had ten rollers 10 supported by three roller support shafts 12. The rollers 10 were disposed in five columns so as not to interfere with objects to be heated during transport. To decrease the production cost, the rollers 10 were disposed at only predetermined effective positions. The unit was supported by heating stabilization device support rods 18 that were connected to the body of the heating apparatus. Heating stabilization device support/sliding portions 19 were provided so that the unit was able to move in the width direction of the steel belt. Because guide rollers 17 followed end portions of the top part of the steel belt, the relative positional relationships between the rollers 10 and the top part of the steep belt 3 was kept the same even when the top part of the steel belt zigzagged.

Figure 19:
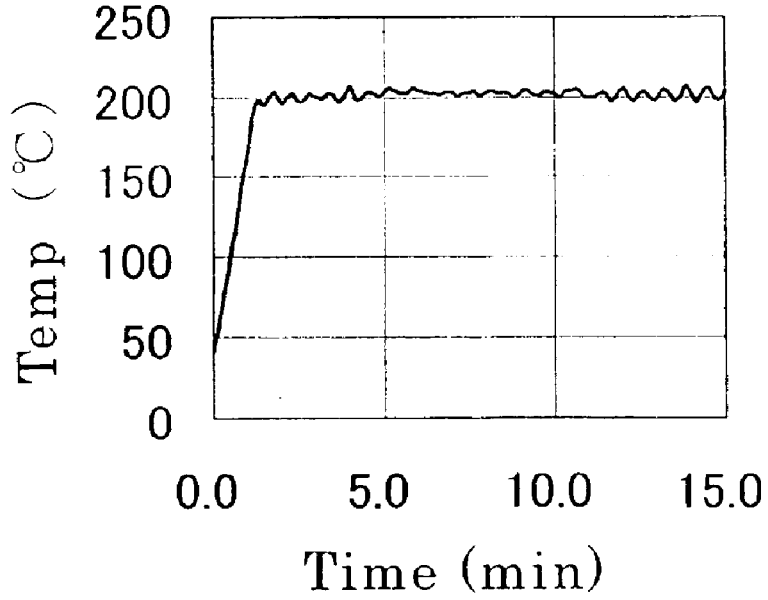
FIG. 19 is a graph showing a temperature variation of a position on the bottom surface of the top part of a steel belt in a heating apparatus having the heating stabilization device of FIGS. 16 and 17.

Five heating stabilization devices having the above structure were prepared and disposed one for every other induction heating coil. A heating experiment similar to the above was conducted. The top part of the steel belt was prevented from being distorted or rising from the steel belt and a stable heating operation was performed for an interval of five hours after the start. FIG. 19 shows a temperature variation (over a time interval of 15 minutes from the start) at a position 50 mm downstream from the seventh coil unit (as counted from the upstream-end coil unit), on the bottom surface of a central portion, in the width direction, of the top part of the steel belt. The temperature was stable for the setting temperature of 200° C. Objects were heated while being transported on the steel belt.

The invention provides the following advantages. The food heating apparatus can include a steel belt conveyer having a steel belt whose top part serves for transport and heating, and induction heating coils each of which has an elliptical or rectangular shape and which are disposed under or over the top part of the steel belt such that the longitudinal direction of each of the induction heating coils forms an angle of 45° to 135° inclusive with the moving direction of the steel belt. This apparatus enables uniform heating in the width direction of the steel belt. Where the length of the induction heating coils in the longitudinal direction is greater than the width of the steel belt, magnetic fields produced by only the straight portions of the induction heating coils contribute to heating, thereby attaining uniform heating. Because the belt surface temperature is uniform in the width direction, the frying colors of pieces of food in which importance is given to the color and browning of the fried surface, such as a hamburger, a steak, a Chinese fried meat dumpling, a baked rice ball, two small pancakes with bean jam in between, okonomiyaki (a meat and vegetable pancake), or an omelet, can be made uniform. Such an apparatus can produce products that are uniform and very high in quality.

The invention can also provide a heating stabilization device for a heating apparatus in which an induction heating coil is disposed under the top part of a steel belt of a steel belt conveyer, the top part for transporting and heating, the heating stabilization device including one or a plurality of rollers that are brought into contact with the top surface of the top part of the steel belt so that the top part of the steel belt is prevented from rising during a heating operation. The heating stabilization device enables a stable heating operation. The roller or rollers follow zigzagging of the top part of the steel belt, whereby the relative positional relationship between the roller or rollers and the top part of the steel belt is kept the same and the roller or rollers do not crush object to be heated. The above measures solve the problems relating to the principle of operation of heating apparatuses in which a steel belt and induction heating coils are used and thereby provide an advantage that a heating apparatus can operate with high reliability.

What is claimed is:

1. A heating stabilization device configured for use with a heating apparatus having an induction heating coil disposed adjacent a belt of a conveyer, the heating stabilization device comprising:

a roller comprising a first portion configured to maintain contact with a first surface of the belt to prevent the belt from rising during a heating operation and a second portion configured to maintain contact with a second surface of the belt to prevent displacement of the belt.

2. The heating stabilization device according to claim 1, wherein the roller is configured to follow a horizontal displacement of the belt to maintain a relative positional relationship between the roller and the belt.

3. The heating stabilization device according to claim 1, wherein the first surface comprises one of a top and bottom surface and the second surface comprises a side surface.

4. The heating stabilization device according to claim 1, wherein the first portion has a diameter different that the second portion.

5. The heating stabilization device according to claim 1, wherein the first surface comprises a top surface and the second surface comprises a side surface, and the first portion has a diameter smaller than a diameter of the second portion.

6. A heating stabilization device configured for use with a heating apparatus having an induction heating coil disposed under a top part of a belt of a belt conveyer, the heating stabilization device comprising:

a roller configured to maintain contact with a top surface of a top part of the belt to prevent the belt from rising during a heating operation, wherein the roller comprises a two-step roller including a smaller-diameter roller and a larger-diameter roller bonded to each other concentrically, and wherein the two-step roller is configured to be disposed such that the smaller-diameter roller contacts the top surface of an end portion of the top part of the belt, and a side surface of the larger-diameter roller is configured to laterally contact an outside surface of the end portion of the top part of the belt.

7. A method of heating, comprising:

disposing an induction coil adjacent a belt of a conveyer; and contacting a first surface of the belt with a first portion of a roller to prevent the belt from rising during a heating operation and a second surface of the belt with a second portion of the roller to prevent displacement of the belt.

8. The method according to claim 7, wherein the first portion of the roller contacts one of a top and bottom surface of the belt, and the second portion of the roller contacts a side surface of the belt.

9. The method according to claim 7, wherein the first portion of the roller that contacts the first surface has a diameter smaller than a diameter of the second portion of the roller that contacts the second surface.

10. The method according to claim 7, wherein the first portion of the roller contacts a top surface of the belt, and the second portion of the roller contacts a side surface of the belt, the first portion having a diameter smaller than a diameter of the second portion.

* * * * *